US007707747B2

(12) United States Patent
Nawachi et al.

(10) Patent No.: US 7,707,747 B2
(45) Date of Patent: May 4, 2010

(54) FOOTWEAR OF SHOE STRUCTURE

(75) Inventors: Masao Nawachi, Fukuyama (JP); Mitsuyuki Habara, Fukuyama (JP)

(73) Assignee: Urban-Nawachi Co., Ltd., Fukuyama (JP)

( * ) Notice: Subject to any disclaimer, the term of this patent is extended or adjusted under 35 U.S.C. 154(b) by 638 days.

(21) Appl. No.: 11/661,368

(22) PCT Filed: Feb. 10, 2005

(86) PCT No.: PCT/JP2005/002001

§ 371 (c)(1),
(2), (4) Date: Feb. 28, 2007

(87) PCT Pub. No.: WO2006/030546

PCT Pub. Date: Mar. 23, 2006

(65) Prior Publication Data

US 2008/0086913 A1 Apr. 17, 2008

(30) Foreign Application Priority Data

Sep. 17, 2004 (JP) ..... 2004-271017

(51) Int. Cl.
*A43B 7/26* (2006.01)

(52) U.S. Cl. ..... 36/94; 36/55

(58) Field of Classification Search ..... 036/10, 036/55, 94

See application file for complete search history.

(56) References Cited

U.S. PATENT DOCUMENTS 366,503 A * 7/1887 O'Neill ..... 36/140
963,605 A * 7/1910 Mannesmann ..... 36/140
1,167,019 A * 1/1916 Reed ..... 602/30
1,349,095 A * 8/1920 Parisi ..... 602/30
1,402,375 A * 1/1922 Parisi ..... 602/30

(Continued)

FOREIGN PATENT DOCUMENTS

JP 59-57104 U 4/1984

(Continued)

*Primary Examiner*—Marie Patterson
(74) *Attorney, Agent, or Firm*—Merek, Blackmon & Vorhees, LLC

(57) ABSTRACT

A footwear shoe structure for sports and general outdoor activity, having excellent benefits with respect to hallux vulgas, has an internal half-size tabi (Japanese sock) structure that uses a stretchable cloth and separates the big toe from the other four toes, the internal structure being interposed between an instep covering material and an upper toe part of a sole. The stretching property of the stretchable cloth forming an upper part and the stretching property of the stretchable cloth forming a lower part of the internal structure are differentiated from one another so as to be smaller in the latter than in the former. A partition member 4 formed of a soft elastic material is fitted into a crotch part between a big toe part and a part of the internal structure for the other four toes. In one embodiment, the upper part of the internal structure is formed of two sheets comprising stretchable cloth of nylon or polyester fiber, and a urethane foam 1*c* is interposed therebetween. The lower part is formed in a two-sheet structure in which an insole surface is formed of a stretchable nylon tricot cloth, the face thereof in contact with the inside of the sole is formed of a synthetic fiber flat weave cloth, and a urethane foam is interposed therebetween.

6 Claims, 7 Drawing Sheets

U.S. PATENT DOCUMENTS

| | | | | | |
|---|---|---|---|---|---|
| 1,444,747 | A | * | 2/1923 | McNulty | 36/140 |
| 1,531,493 | A | * | 3/1925 | Maxon | 36/72 B |
| 1,772,179 | A | * | 8/1930 | Finkelstein | 602/30 |
| 2,542,319 | A | * | 2/1951 | Ferri | 602/30 |
| 2,575,867 | A | * | 11/1951 | Ferri | 602/30 |
| 2,575,868 | A | * | 11/1951 | Ferri | 602/30 |
| 2,776,500 | A | * | 1/1957 | Gonsalves | 36/10 |
| 3,013,564 | A | * | 12/1961 | Levey | 36/170 |
| 3,025,617 | A | * | 3/1962 | Rizzonelli | 36/72 B |
| 3,153,289 | A | * | 10/1964 | Martin | 36/72 B |
| 3,270,442 | A | * | 9/1966 | Liebmann et al. | 36/100 |
| 3,334,356 | A | * | 8/1967 | Abel | 2/239 |
| 3,967,390 | A | * | 7/1976 | Anfruns | 36/94 |
| 4,461,100 | A | * | 7/1984 | Minor et al. | 36/72 B |
| 4,498,252 | A | * | 2/1985 | Connors | 36/72 B |
| 4,745,927 | A | * | 5/1988 | Brock | 36/140 |
| 4,756,097 | A | * | 7/1988 | Sanders | 36/72 B |
| 5,052,129 | A | * | 10/1991 | Lobasso et al. | 36/72 R |
| 5,257,469 | A | * | 11/1993 | Beasley | 36/72 R |
| 5,259,126 | A | * | 11/1993 | Rosen | 36/93 |
| 5,357,694 | A | * | 10/1994 | Mauck | 36/72 B |
| 5,361,517 | A | * | 11/1994 | Liener | 36/72 R |
| 5,771,607 | A | * | 6/1998 | Dean | 36/72 B |
| 6,775,927 | B2 | * | 8/2004 | Glicksman | 36/36 R |
| 7,082,703 | B2 | * | 8/2006 | Greene et al. | 36/89 |
| 7,134,225 | B2 | * | 11/2006 | Ashton | 36/94 |
| 2003/0172555 | A1 | * | 9/2003 | Chu | 36/113 |
| 2007/0011915 | A1 | * | 1/2007 | Allen | 36/94 |
| 2007/0163149 | A1 | * | 7/2007 | Urbach et al. | 36/72 B |
| 2008/0196279 | A1 | * | 8/2008 | Epping | 36/72 B |

FOREIGN PATENT DOCUMENTS

| | | | |
|---|---|---|---|
| JP | 3-87402 | U | 9/1991 |
| JP | 3001660 | U | 9/1994 |
| JP | 09-047302 | | 2/1997 |
| JP | 09-206101 | | 8/1997 |
| JP | 09-238701 | | 9/1997 |
| JP | 11-032805 | | 2/1999 |
| JP | 2001-128701 | | 5/2001 |
| JP | 2001-128705 | | 5/2001 |
| JP | 3484118 | B | 1/2004 |

* cited by examiner

A

B

FOOTWEAR OF SHOE STRUCTURE

CROSS-REFERENCE TO RELATED APPLICATION

The present application claims the priority under 35 U.S.C. 119 of Japanese Patent Application No. 2004-271017, filed Sep. 17, 2004, which is hereby incorporated herein by reference in its entirety.

FIELD OF THE INVENTION

The invention relates to a shoe structure, wherein the inside of the toe thereof is formed into a tabi (Japanese sock).

BACKGROUND OF THE INVENTION

Although a conventional rubber-soled tabi is footwear having work performance and freedom of movement, it is not fit for general sports and ordinarily going out because the toe thereof is split. Furthermore, although some shoes have insteps with a large circumference and some shoes have soft material to prevent hallux vulgas, none of them have any effect on a person whose large toe has been already deformed. On the other hand, although some shoes having partition members inserted into crotch parts are disclosed in some laid-open patent applications, they are unsuitable for many hours of wear because the mere partition member can not deal with the degree of deformation of the big toe. Furthermore, although there are some shoes having sandal straps, they similarly can not effectively and positively prevent the deformation of the big toe. When the big toe bends outside once, it is difficult to correct the hallux vulgas, and therefore, suitable manufactured goods have not been provided yet. Furthermore, there is a safety shoe having a box toe fitted around the toe as a protection member. In this case, although an opening space is formed between the toes, the toes move laterally during walking, thereby increasing fatigue and decreasing work ability.

Known shoe structures are disclosed in: Patent Document 1—Japanese Patent No. 3484118 official gazette; Patent Document 2—Japanese Patent Provisional Publication No. 1997-47302 official gazette; Patent Document 3—Japanese Patent Provisional Publication No. 1997-206101 official gazette; Patent Document 4—Japanese Patent Provisional Publication No. 1997-238701 official gazette; Patent Document 5—Japanese Patent Provisional Publication No. 1999-32805 official gazette; and Patent Document 6—Japanese Patent Provisional Publication No. 2001-128701 official gazette.

SUMMARY OF THE INVENTION

An object of the invention is to provide a shoe structure used while a person works, participates in sports and ordinarily goes out, the shoe structure having excellent effects on the stoppage of the advance of, and on the correction of, hallux vulgas.

Problems to be Solved by the Invention

An internal structure of a half-size tabi (Japanese sock) using a stretchable cloth and separating the big toe from the other four toes is interposed between an instep covering material and the upper toe part of a sole. The upper part of the internal structure is formed of at least two sheets comprising stretchable cloth, whereas the lower part is formed of one or two sheets comprising stretchable cloth, wherein the stretching property of the stretchable cloth of the lower part is smaller than the stretching property of the stretchable cloth of the upper part. A partition member formed of a soft elastic material is fitted into a crotch part of the internal structure between a big toe part of the internal structure and a part of the internal structure for the other four toes.

In one embodiment, the upper part of the internal structure is formed of two sheets comprising stretchable cloth of nylon or polyester fiber and urethane foam interposed therebetween. The lower part is formed in a two-sheet structure in which an insole surface is formed of a stretchable nylon tricot cloth, a face in contact with the inside of the sole is formed of a synthetic fiber flat weave cloth, and urethane foam is interposed therebetween.

The thickness around a root of the partition member at the crotch part may be larger than the other parts of the partition member.

In addition, footwear according to the invention can be formed as a safety shoe type in which a box toe member for protecting a toe is imposed between the instep covering member and the internal structure. The box toe member is made of steel sheets or fiber-reinforced plastics. In the partition member, the thickness is about 3 mm to 10 mm, the length from a toe of the partition member to the root of the partition member at the crotch part is about 25 mm to 50 mm, and the height of the root is about 20 mm to 30 mm. Furthermore, a circular arc is formed upwardly from the toe to the root. At least an upper surface of the root of the partition member is fixed on the inside of the instep covering material, and the bottom is fixed on the sole. In this case, in the footwear having the box toe, an upper surface of the partition member is fixed on the inside of the box toe.

Effect of Invention

In this invention, the internal structure of a half-size tabi (Japanese sock) using stretchable cloth and separating the big toe from the other four toes is placed on the inside of the toe of a shoe structure, and a partition member formed of soft elastic material is fitted into a crotch part of the internal structure, between the big toe and the other four toes. According to this, the crotch part and the partition member completely separate the big toe and the other four toes inside the toe of the shoe structure. In addition, the partition member, together with the half-size tabi structure using the stretchable cloth, helps stop the advance of hallux vulgas and helps correct hallux vulgas without spoiling any freedom of movement. That is, even if the big toe exhibits hallux vulgas, the soft elastic material having a fixed thickness and hardness soon and precisely holds in the crotch part so as to freely move the big toe. Therefore, the stoppage of the advance of hallux vulgas and the correction of hallux vulgas can be always naturally performed. This feature is due to the internal structure being formed into the half-size tabi structure that is separated from the heel part of the shoe structure. This internal structure is excellent because it can be simply and easily fitted to shoes of various forms regardless of the shape of the heels of the shoes. Furthermore, the upper part of the internal structure is formed of at least two sheets comprising stretchable cloth, and the lower part is formed of one or two sheets comprising stretchable cloth, wherein the stretching property of the stretchable cloth of the lower part is smaller than the stretching property of the stretchable cloth of the upper part. According to this, the footwear can be conveniently sewn into various foot shapes, is easy to wear, has a comfortable feeling that the instep is properly tightened, and is not tiring even if worn for a long time.

Where the stretchable cloth of the upper part and the stretchable cloth of the lower part of the internal structure are respectively formed in a two-sheet structure and a urethane foam of fixed thickness and hardness is imposed therebetween, the footwear is even more comfortable and less tiring.

The usual rubber-soled tabi for work has no protection members at the toe, and therefore, it has no protection against falling objects. However, according to the invention, the box toe for protecting the toes of the wearer can be imposed between the instep covering material and the internal structure at the toe end, and can greatly contribute to safety in work in the field, besides helping to stop and correct hallux vulgas.

In conventional general safety shoes, the shape of the box toe is formed slightly larger than a last. Accordingly, while walking, the big toe is not fixed in place, thereby allowing lateral movement of the big toe inside the toe of the shoe. Accordingly, tread power can not be positively imparted to the ground, thereby heavily fatiguing the foot during working, as well as during walking. However, where the internal structure of the half-size tabi of the invention is inserted, where the cloth of the upper part thereof is differentiated from the cloth of the lower part, and where the partition member formed of the soft elastic material is inserted into the crotch part of the internal structure, between the big toe and the other four toes, the lateral movement of the foot can be remarkably prevented. In addition, freedom of movement is not compromised, and contact with the ground is fine.

The appearance of the toe of a shoe structure employing the present invention is entirely round, which is a common shape, and therefore, a person having hallux vulgas can wear shoes without looking different. Furthermore, the present invention is also effective in special shoes, such as for sports, working, climbing and golfing.

PREFERRED EMBODIMENT OF THE INVENTION

A shoe structure according to the present invention, which is for use while a person participates in sports and ordinarily goes out, is well fitted to the ground and easy to wear. The shoe structure also has excellent effects in stopping the advance of hallux vulgas and correcting hallux vulgas due to the fitting of a special internal structure of a half-size tabi into the toe.

Example 1

A running shoe will be explained as an example of the invention reference to drawings.

Figure 1:
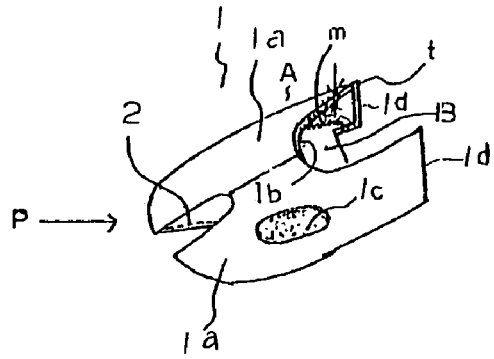
FIG. 1A is a perspective view of an internal structure used in the invention.
FIG. 1B is a transverse sectional view thereof.
Figure 1:
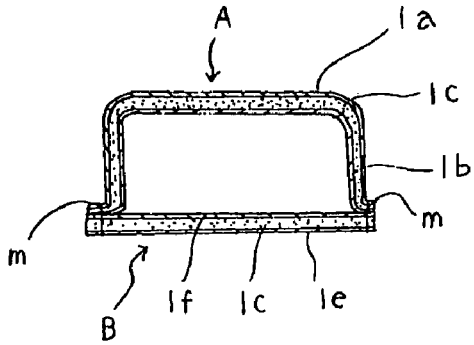

FIG. 1 is a perspective view of a special internal structure of the invention, namely an internal structure 1 of a half-size tabi inserted into the toe of a shoe. Here, the upper part A of the internal structure 1 is formed of two sheets 1*a*, 1*b* comprising stretchable cloth of nylon or Dacron knitted material, with a urethane foam 1*c* interposed therebetween. The thickness t thereof is 2 mm to 5 mm. As shown in the drawing, a crotch part 2 is formed in a toe part p so as to partition the big toe and the other four toes of a foot at an adequate interval.

The lower part B of the internal structure 1 is formed in a two-sheet structure in which a face in contact with the inside of the sole is formed of a synthetic fiber flat weave cloth 1*e* whose stretch is inferior to the that of the upper part A (which can even be non-stretchable), an insole surface is formed of a stretchable nylon tricot cloth 1*f*, and an urethane foam 1*c* is positioned therebetween similarly. In this case, since the face in contact with the inside of the sole is formed of the flat weave cloth 1*e*, a seam of a sewn part m between the upper part A and the lower part B is pulled so as to be always positioned at the inside of the sole and not to move vertically on the left and right sides while hanging on various lasts. This is very important to make the shoe easy to wear and comfortable without feeling incompatible with the sole.

Figure 2:
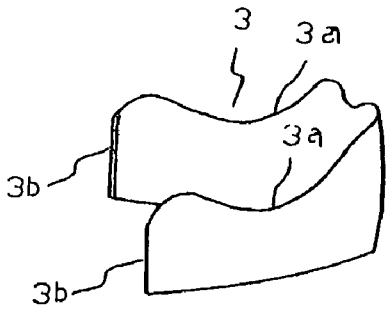
FIG. 2 is a perspective view of a pad material, used with the invention, for an opening of a shoe for inserting a foot.

FIG. 2 is a perspective view of a pad member 3 for an opening of a shoe for inserting a foot. The upper edge 3*a* of the pad material 3 is sewn to the instep covering side, and left and right side edges 3*b* are sewn to left and right free side parts 1*d* of the internal structure 1.

Figure 3:
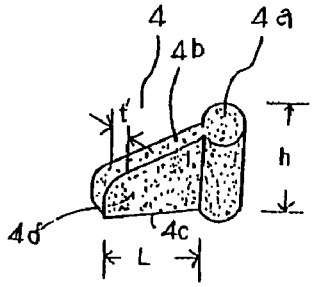
FIG. 3 is a perspective view of a partition member used in the invention.

FIG. 3 shows a partition member 4 to be inserted into the crotch part 2 of the internal structure, the partition member being formed of a soft elastic material such as latex sponge, urethane sponge, rubber sponge and EVA sponge. The hardness of the partition member 4 is about 5 degrees to 35 degrees on a C hardness meter. The thickness t' thereof is about 3 mm to 10 mm, the length from a toe of the partition member to the root of the partition member at the crotch part of the internal structure is about 25 mm to 50 mm, and the height of the root is about 20 mm to 30 mm. In addition, a circular arc is formed upwardly from the toe to the root. As can be seen from FIGS. 3 and 5, the root is formed as a cylindrical body 4*a* that is about 2 mm to 5 mm wider than the thickness t' of the rest of the partition member.

Accordingly, the stoppage of the advance of hallux vulgas and the correction of hallux vulgas are easily accomplished by suitably changing the thickness of the partition member 4 and the shape of the cylindrical body 4*a*.

Figure 4:
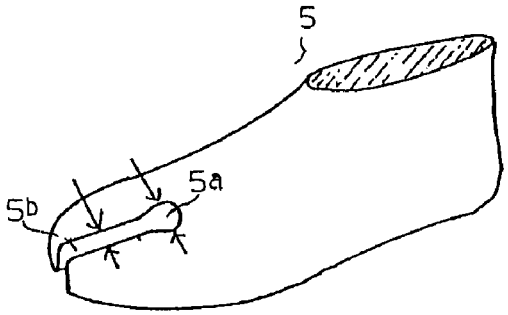
FIG. 4 is a perspective view of a last used in the invention.

FIG. 4 shows a last 5 formed so that the partition member 4 can be inserted easily. More specifically, the width 5*b* of the crotch part is about 3 mm to 7 mm, a root of the crotch part is formed cylindrical, and the width 5*a* thereof is about 5 mm to 15 mm.

Figure 5:
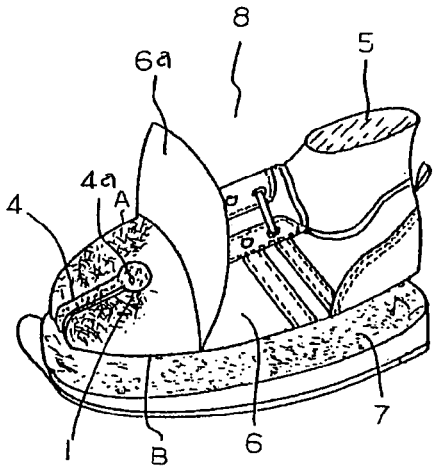
FIG. 5 is a perspective view, with a portion of an instep covering material lifted and the sole still separate, of a shoe according to the present invention during production.

FIG. 5 is a perspective view, with a portion of an instep covering material lifted and the sole still separate, showing a running shoe 8 produced from the internal structure 1 and the partition member 4. In the figure, 5 is a last, 6 is an instep covering material, and 7 is a sole member. In this embodiment of the invention, the partition member 4 is inserted into the crotch part 2 of the internal structure 1 of the special half-size tabi. In addition, the upper part of the cylindrical body 4*a*, which is a swelling body, of the partition member 4 is fixed at least on a back face 6*a* of the instep covering member 6 on the toe side by an adhesive agent, whereas the lower part is fixed on the sole member 7 by sizing. On the other hand, the toe side is hung to be fit to the shape of the last, finished in a rounded toe, and thereafter put on the sole member 7 with the adhesive agent.

Figure 6:
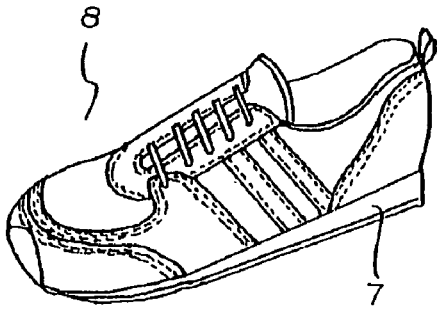
FIG. 6 is a perspective view of a running shoe showing an example of the invention.

FIG. 6 shows the running shoe 8. In the invention, the internal structure 1 of the half-size tabi formed of the stretchable cloth and the partition member 4 having suitable hardness are put on the toe side between the instep covering material and the sole, and other structure is produced according to a conventional shoe method.

When performing the above-mentioned sizing, the upper face of the cylindrical body 4*a* that forms the root of the partition member 4 is fixed at least on the back face 6*a* of the instep covering member 6 by the adhesive agent. However, an arc part 4*b* need not always be fixed. However, a bottom face part 4*c* of the partition member 4 must certainly be fixed on the sole member 7 by the adhesive agent. The upper cloth 1*a* of the upper part A forming a two-sheet structure of the internal structure 1 is fixed on the back face 6*a*, whereas the flat weave cloth 1*c* of the lower part B is fixed on the sole member 7 by the adhesive agent. Here, although a side face part 4*d* forming vertical faces of the partition member 4 may be fixed on the crotch part of the internal structure 1, it is preferable to leave the side face part 4*d* freely rocking without fixing, because then freedom of movement is increased while the internal structure 1 of the half-size tabi is provided.

In the above-mentioned example, although the lower part B of the internal structure 1 is formed in a two-sheet structure, it may be formed in a one-sheet structure (not shown). In this case, the lower part B is formed of a non-stretchable cloth or of a cloth inferior in stretchability to that of the upper part A, such as a flat weave cloth.

Example 2

Figure 7:
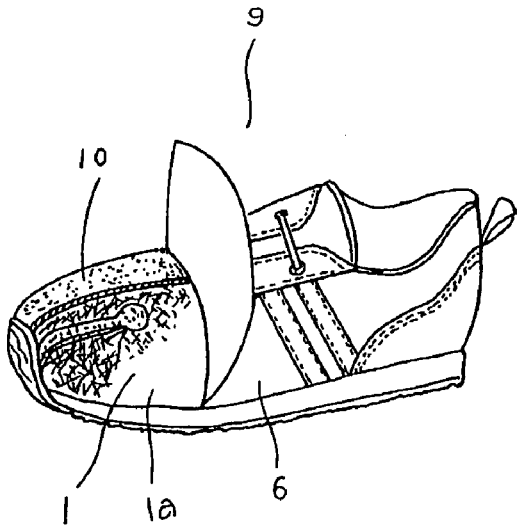
FIG. 7 is a perspective view, with a portion of an instep covering material lifted, of a safety shoe showing an example of the invention.

FIG. 7 is a perspective view, with a portion of an instep covering material lifted, of a safety shoe 9 of the invention. The safety shoe 9 has a box toe member 10 in the toe as a protection member. As shown in figure, the box toe member 10 is interposed between the instep covering material 6 and the internal structure 1. Specifically, the upper cloth 1*a* of the internal structure 1 is firmly fitted into the safety shoe 9 by being fixed on the inside of the box toe member 10 by an adhesive agent. Therefore, while keeping the safety feature of the box toe member 10, the safety shoe 9 has effects on the stoppage of the advance of hallux vulgas and the correction of hallux vulgas due to the internal structure 1, as in the case of Example 1. Well-known structures for protecting the toe, such as steel sheets or fiber-reinforced plastics, can be used as the box toe member 10.

In the above-mentioned examples, although a running shoe and a safety shoe are respectively explained, the footwear of the invention is not restricted to these, but can be applied to all sport shoes, chemical shoes for children, and footwear having special shoe structures, such as golf shoes and mountaineering shoes.

Making the internal structure 1 a half-size tabi structure using stretchable cloth in the invention has a synergistic effect with the partition member 4 in keeping the partition member 4 between the big toe and the other toes. Furthermore, the partition member 4 can provide extremely comfortable stimulation in addition to being soft and freely rockable.

The footwear of the invention constitutes fine manufactured goods that have an external appearance no different from that of conventional sports shoes and that are easy to wear. Particularly, freedom of movement with the footwear of the invention is good. In addition, while walking, a person can feel stimulation in the crotch part of the internal structure, which is not felt with conventional goods. Structurally, the partition member separates toes, thereby giving a strong feel for the ground to each toe and preventing lateral movement of toes when the foot strikes the ground, thereby increasing stability. Simultaneously, the stimulation in the crotch part of the internal structure improves health. Therefore, the stoppage of the advance of hallux vulgas, the correction of hallux vulgas, and the decreasing of fatigue are effectively achieved. The feature of the half-size tabi structure centered in the instep part can be applied to various comfortable shoes having excellent freedom of movement. Furthermore, these goods can be produced inexpensively and easily.

The invention claimed is:

1. A shoe structure, comprising:

an internal structure in the form of a half-size tabi using a stretchable cloth, said internal structure separating a big toe from the other four toes and being interposed between an instep covering material and an upper toe part of a sole, an upper part of said internal structure being formed of at least two sheets comprising stretchable cloth, and a lower part of said structure being formed of one or two sheets of stretchable cloth, the stretching property of the stretchable cloth of the lower part being smaller than the stretching property of the stretchable cloth of the upper part; and a partition member formed of a soft elastic material fitted into a crotch part of said internal structure between a big toe part of said internal structure and a part of said internal structure for the other four toes.

2. A shoe structure as claimed in claim 1, wherein the upper part of said internal structure is formed of two sheets comprising stretchable cloth of nylon or polyester fiber and urethane foam interposed between the two sheets, and the lower part of said internal structure is formed in a two-sheet structure in which an insole surface is formed of a stretchable nylon tricot cloth, a face in contact with an inside of the sole is formed of a synthetic fiber flat weave cloth, and urethane foam is interposed between the stretchable nylon tricot cloth and the synthetic fiber flat weave cloth.

3. A shoe structure as claimed in claim 1, wherein the partition member has a root at the crotch part of said internal structure, and the thickness of the partition member at the root is larger than the thickness of the other parts of the partition member.

4. A shoe structure as claimed in claim 1, wherein a box toe member for protecting a toe is interposed between the instep covering member and said internal structure, the box toe member being made of steel sheets or fiber reinforced plastics.

5. A footwear of a shoe structure as claimed in claim 1, wherein the thickness of the partition member is about 3 mm to 10 mm, the length of the partition member from a toe of the partition member to a root of the partition member at the crotch part is about 25 mm to 50 mm, the height of the root is about 20 mm to 30 mm, an arc is formed upwardly from the toe to the root, and at least an upper face of the root of the partition member is fixed on the inside of the instep covering material, and the bottom of the root is fixed on the sole.

6. A shoe structure as claimed in claim 4, wherein the thickness of the partition member is about 3 mm to 10 mm, the length from the toe to the root is about 25 mm to 50 mm, the height of the root is about 20 mm to 30 mm, an arc is formed upwardly from the toe to the root, at least an upper face of the root of the partition member is fixed on the inside of the box toe member, and the bottom of the root is fixed on the sole.

* * * * *